United States Patent [19]

Williams et al.

[11] Patent Number: 4,716,673

[45] Date of Patent: Jan. 5, 1988

[54] GUN BARREL CLEANER AND CONTAINER THEREFOR

[76] Inventors: Gerald Williams; Doreen Williams, both of 227 Higby Rd., Utica, N.Y. 13501

[21] Appl. No.: 883,588

[22] Filed: Jul. 9, 1986

[51] Int. Cl.[4] ..... F41C 31/00; B65D 57/00

[52] U.S. Cl. ..... 42/95; 15/104.16; 57/221; 206/407; 206/389; 228/115

[58] Field of Search ..... 42/95, 96; 15/104.05, 15/104.16, 104.165; 206/407, 408, 389; 57/221; 228/115, 116; 43/43.11; 220/266

[56] References Cited

U.S. PATENT DOCUMENTS

| | | | |
|---|---|---|---|
| 943,202 | 12/1909 | Struss | 206/389 |
| 1,665,988 | 4/1928 | Smith | 15/104.165 |
| 2,544,847 | 3/1951 | Malesky | 42/95 |
| 2,559,376 | 7/1951 | Schnitger | 42/95 |
| 2,616,109 | 11/1952 | Gardner | 15/104.165 |
| 2,834,973 | 5/1958 | Friesen | 15/104.165 |
| 2,867,319 | 1/1959 | Jones et al. | 206/407 |
| 2,897,525 | 8/1959 | Goodwin et al. | 42/95 |
| 2,974,400 | 3/1961 | Sowa | 29/862 |
| 3,137,957 | 6/1964 | Ingalls | 42/95 |
| 3,208,302 | 9/1965 | Lewis et al. | 42/95 |
| 4,258,859 | 3/1981 | Westphal | 220/266 |
| 4,344,278 | 8/1982 | Jamison et al. | 57/221 |
| 4,399,627 | 8/1983 | Malesky et al. | 41/95 |
| 4,499,625 | 2/1985 | Bottomley | 15/104.165 |
| 4,547,924 | 10/1985 | Brygidor | 42/95 |
| 4,606,183 | 8/1986 | Riggs | 57/221 |

OTHER PUBLICATIONS

*Stoeger Gun Catalog and Handbook,* No. 31, "Cleaning Kits", pp. 210–214, 1939 Jubilee Issue.

*The Welding Journal,* "Pressure Welding", Aug. 1951, pp. 728–736.

*Primary Examiner*—Harvey E. Behrend

*Assistant Examiner*—Michael J. Carone

*Attorney, Agent, or Firm*—Heslin & Rothenberg

[57] ABSTRACT

A gun barrel cleaner comprises an elongated flexible shaft having a universal coupling secured to each opposite end and several different cleaning tips selectively threadably and detachably engageable with either universal coupling. One cleaning tip, a gun barrel bore obstruction remover, comprises a cylindrical body portion having a concave face at one end and securing means at the other end for attaching the tip to the shaft. A compact cylindrical container for storing and conveniently transporting the gun barrel cleaner is provided. In addition, an improved method of attaching a cleaning patch to a gun barrel cleaning tip having a patch receiving slot is provided.

29 Claims, 12 Drawing Figures

FIG. 5
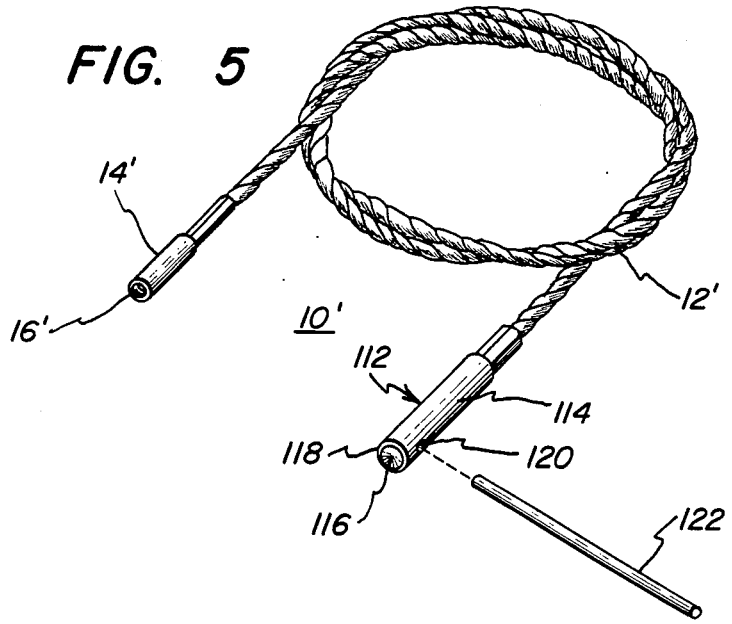
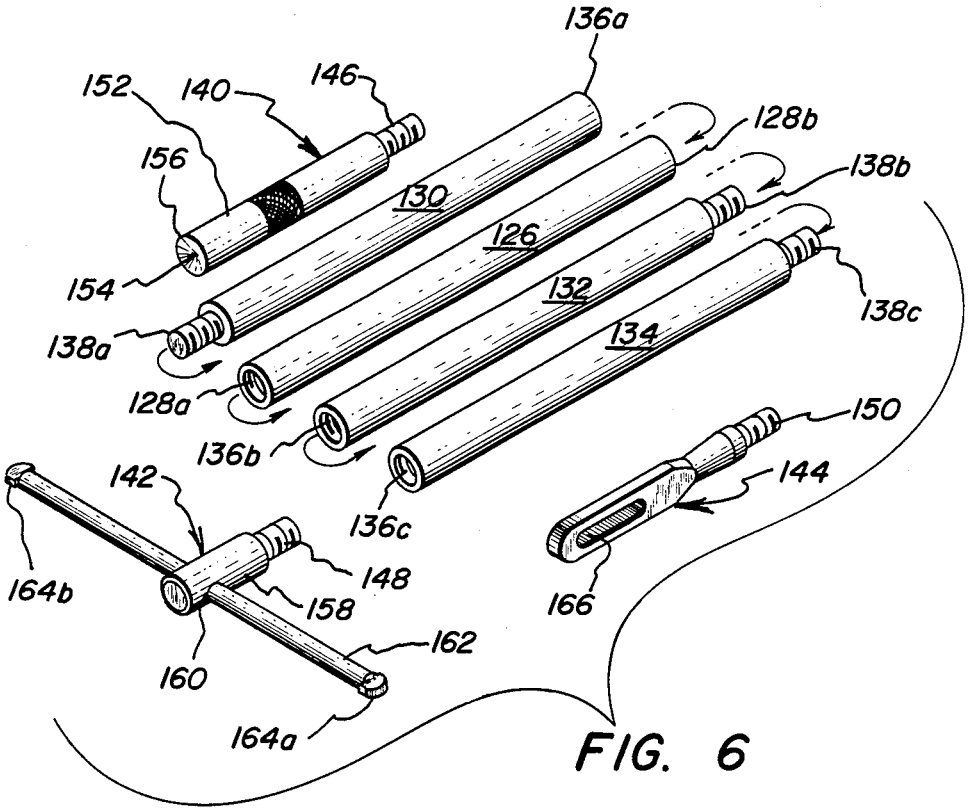
FIG. 6

FIG. 8a
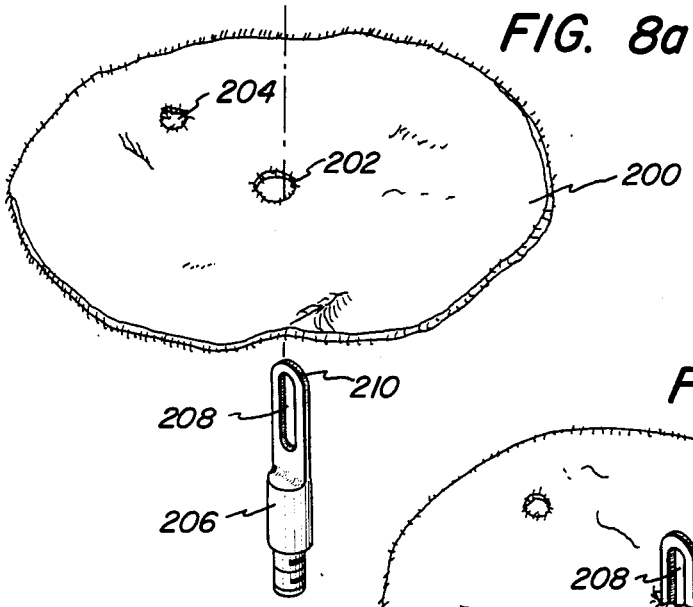
FIG. 8b
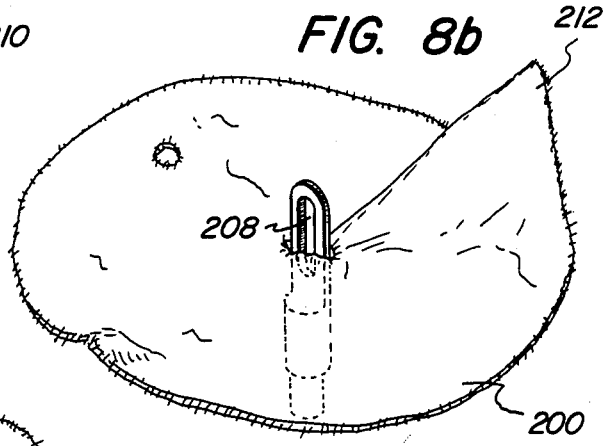
FIG. 8c
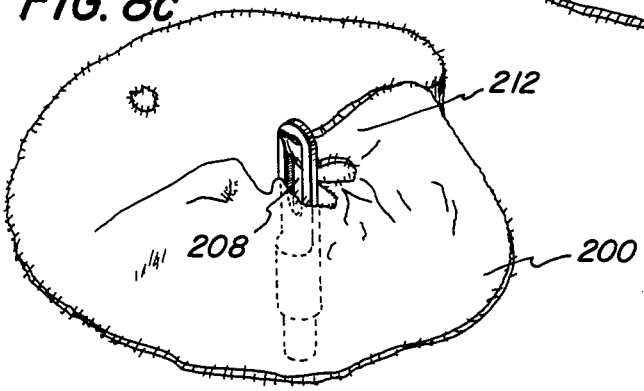
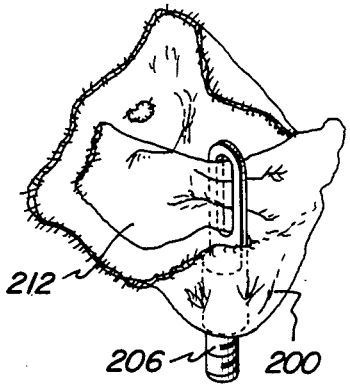
FIG. 8d
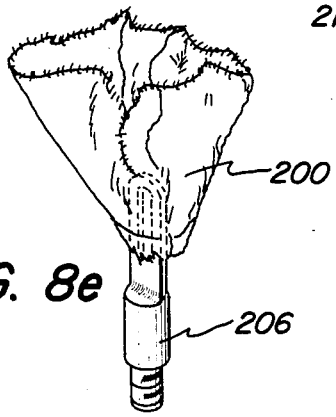
FIG. 8e

GUN BARREL CLEANER AND CONTAINER THEREFOR

BACKGROUND OF THE INVENTION

The present invention relates generally to gun barrel cleaning devices, and more particularly, to a gun barrel cleaner having a flexible shaft and a compact container for storing and transporting such a gun barrel cleaner.

Although a sportsman's firearm is typically cleaned at home, it sometimes is desirable or absolutely necessary to clean a gun barrel in a field or camp. For example, if a gun barrel bore becomes clogged with mud or snow while a sportsman is hunting, the hunter must for his own safety remove the obstruction from the barrel bore. Often, when a hunter has such a bore obstruction in his gun it is not convenient or expeditious for him to return home for the sole purpose of cleaning the gun barrel.

In the past, most gun barrel cleaning devices comprised an elongated rigid rod having a cleaning brush secured to one end. Such cleaning devices were obviously cumbersome to transport and difficult to store because of their length and rigidity. Many attempts have been made to produce a less cumbersome gun barrel cleaning device. For example, Lewis et al., in U.S. Pat. No. 3,208,302, and Schnitger, in U.S. Pat. No. 2,559,376, each disclose an elongated gun cleaning device constructed of a plurality of axially aligned pieces which can be partially disassembled. Even so, in both devices a relatively long length of rigid rod remains, to which pieces can be added. Thus, these devices are still quite cumbersome to store and transport.

Another, more effective, approach to producing a less cumbersome product has been to incorporate a flexible cleaning shaft as part of the gun barrel cleaning/device. For example, Malesky, in U.S. Pat. No. 4,399,627, discloses a gun cleaning device having an elongated flexible shaft with a slotted link swivelly secured to one end of the flexible shaft and a tubular coupling member swivelly secured to the other end of the flexible shaft. The shaft essentially consists of several layers of tightly wound metal coil and is sufficiently flexible to be wound yet is resistant to torque. There are several drawbacks, however, to such known gun barrel cleaning devices having flexible cleaning shafts.

First and most importantly, such gun cleaning devices can only endure the application of fairly low pressures before breaking. It may be desirous in the course of cleaning a gun barrel to pull a relatively large cleaning patch through a gun barrel bore to effect a more efficient cleaning of the barrel. If a slightly oversized cleaning patch is to be pulled through a barrel bore, the application of significant pulling force or pressure may be necessary, the magnitude of which most cleaning devices having flexible shafts are unable to withstand. Obviously, should a portion of a gun barrel cleaning device break within a barrel bore, a bore obstruction is created which will be difficult and time consuming to remove.

Secondly, such gun barrel cleaning devices are normally restricted either in terms of the range of gun barrel bore diameters which may be properly cleaned thereby or in terms of the number and type of cleaning tip combinations which may be attached to the flexible shaft to facilitate gun barrel cleaning. For example, in the noted Malesky patent since the flexible shaft has a slotted link permanently swivelly secured at one end, a limited number of cleaning tip combinations are possible, which necessarily restricts the versatility and usefulness of the cleaning device.

Lastly, such gun barrel cleaning devices generally have inadequate, inconvenient or unnecessarily limiting storage and transportation containers or structures. For example, Goodwin et al., in U.S. Pat. No. 2,897,525, describes a cleaning device having two different cleaning tips secured to opposite ends of a flexible cleaning shaft. One cleaning tip has a slot or eye therein and the other tip consists of a brush with an elongated portion at its free end such that when the flexible shaft is coiled the elongated portion is capable of being engageably retained within the eye, thereby ensuring the cleaning shaft remains in a coiled position. There are several drawbacks, however, to such a storage approach, primarily resulting from permanent attachment of the cleaning tips to the flexible shaft. Since the cleaning tips are affixed to the flexible shaft a somewhat larger coiled form than could otherwise be obtained necessarily exists and the versatility and usefulness of the cleaning device is necessarily limited.

Therefore, there presently exists a genuine need for a gun barrel cleaning device having a flexible shaft which is capable of withstanding moderate and high pulling stresses, and which is capable of cleaning a wide range of gun barrels quickly and efficiently. Further, there is a need for a compact container for storing and transporting such a gun barrel cleaner.

SUMMARY OF THE INVENTION

Accordingly, it is a primary object of the present invention to provide an improved gun barrel cleaner having a flexible shaft capable of withstanding moderate to high pulling stresses.

Another object of the present invention is to provide a gun barrel cleaner which can clean a wide range of gun barrels quickly and efficiently.

Still another object of the present invention is to provide a gun barrel cleaner container which is compact and can fit within a sportsman's clothing pocket for easy storing and transporting of the gun barrel cleaner.

A further object of the present invention is to provide a gun barrel cleaner which does not scratch or otherwise damage a gun barrel.

A still further object of the present invention is to provide a gun barrel bore obstruction remover which can dislodge a bore obstruction, and particularly a bullet obstruction, safely and efficiently.

It is yet another object of the present invention to provide an improved method of attaching a cleaning patch to a gun barrel cleaning tip having a patch receiving slot therein, to effect a more efficient cleaning of a gun barrel.

The present invention accomplishes these objects in one aspect by providing a gun barrel cleaner having a flexible shaft substantially unyielding in an axial direction for barrel cleaning and laterally bendable for compact coiling. Secured to each opposite end of the flexible shaft is a universal coupling; each coupling having a substantially identical threaded internal bore. In addition, at least two different cleaning tips are provided which have threaded stems capable of selective threadable and detachable engagment with the threaded internal bore within either of the universal couplings, thereby facilitating cleaning of a gun barrel and storage of the gun barrel cleaner. A compact container for storing and transporting such a gun barrel cleaner is also provided.

In another aspect of the present invention, a gun barrel bore obstruction remover cleaning tip having a cylindrical body portion, a concave face at one end and means for securing the cleaning tip to a gun barrel cleaning shaft at the other end, is provided. The obstruction remover cleaning tip operates to dislodge barrel bore obstructions by impacting such obstructions. When a bullet is lodged within a barrel bore, the obstruction remover cleaning tip is maintained in a centered position about the bullet by the concave end face, thereby facilitating safe removal of the obstruction.

In yet another aspect of the present invention, a method of affixing a cleaning patch having at least one hole or slot therein to a gun barrel cleaning tip having a patch receiving slot is provided. The method includes the steps of placing one end of the cleaning tip through a hole in the cleaning patch, holding the patch near the cleaning tip's patch receiving slot, folding an edge portion of the patch together on either side of the cleaning tip, feeding the folded edge portion back through the patch receiving slot and pulling the folded edge taut so that when the combination is pulled through a gun barrel bore the cleaning patch will surround the cleaning tip in a substantially uniform manner, thus ensuring a more efficient cleaning of the gun barrel.

BRIEF DESCRIPTION OF THE DRAWINGS

While the specification concludes with claims particularly pointing out and distinctly claiming the present invention, the objects, features and advantages of the present invention can be more readily ascertained from the following detailed description of one preferred embodiment when read in conjunction with the accompanying drawings in which:

FIG. 5 is a perspective view of an alternate embodiment of the gun barrel cleaner invention;

FIG. 6 is a perspective view of a gun barrel cleaner of the present invention for use in cleaning pistols;

FIGS. 8*a–e* are perspective views of a cleaning patch and a gun barrel cleaning tip having a patch receiving slot which are useful in explaining an improved cleaning patch attachment method of the present invention.

DETAILED DESCRIPTION OF THE INVENTION

Figure 1:
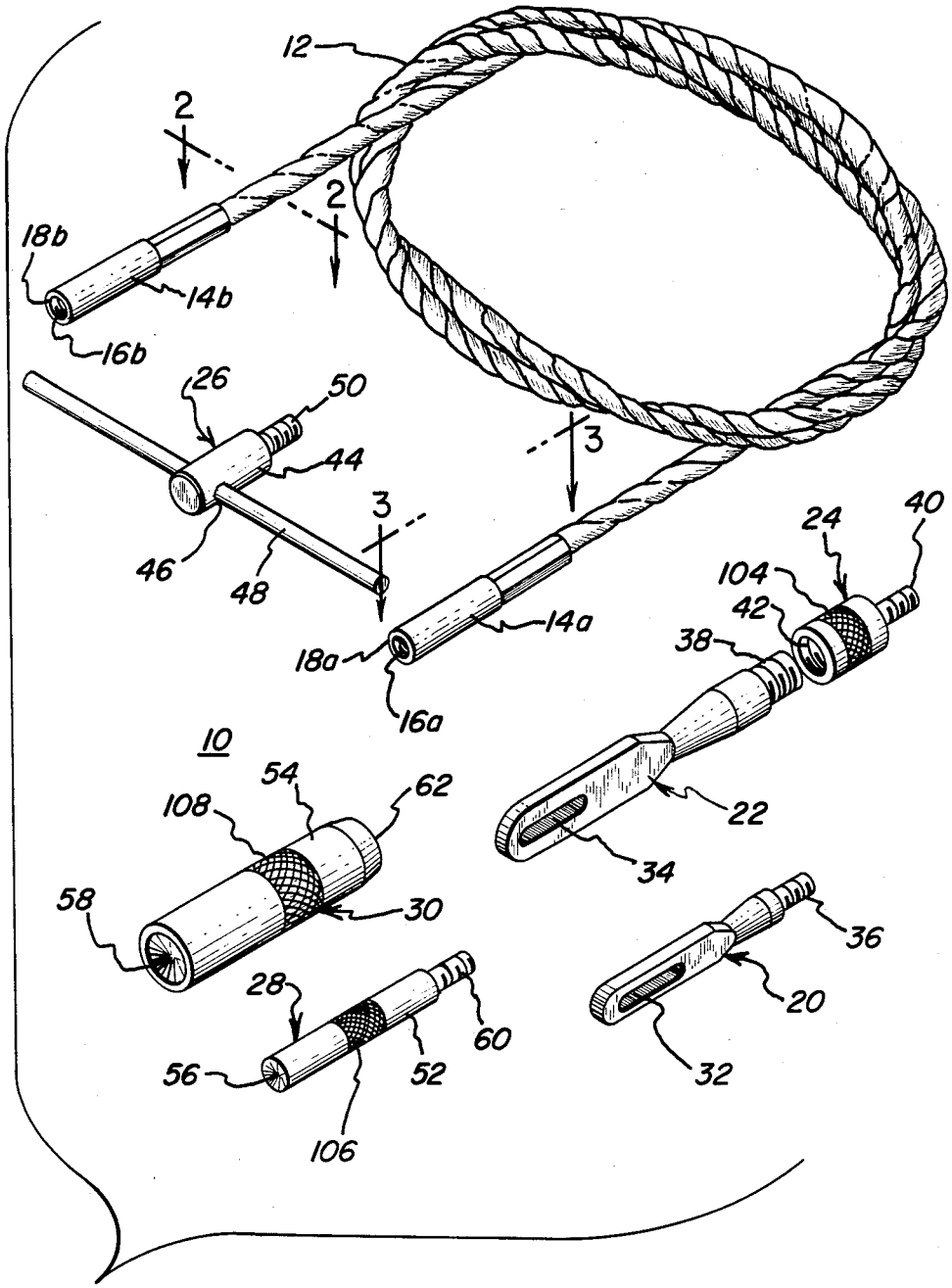
FIG. 1 is a perspective view of one embodiment of a gun barrel cleaner invention having several different cleaning tips which can be selectively attached to a flexible shaft.

One embodiment of a gun barrel cleaner, generally denoted as 10, is shown perspectively in FIG. 1. Gun barrel cleaner 10 has a flexible shaft 12 which is substantially unyielding in an axial direction for gun barrel cleaning and laterally coilable for compact storing. Attached to opposite ends of shaft 12 are universal couplings 14*a* and 14*b*. Each coupling 14*a* and 14*b* has a substantially identical threaded internal bore 16*a* and 16*b*, respectively, at its free end 18*a* and 18*b*. Selectively threadably attachable to couplings 14*a* and 14*b* are gun barrel cleaning tips 20, 22 (via adaptor coupling 24), 26, 28 and 30.

Cleaning tips 20 and 22 each have a cleaning patch receiving slot 32 and 34 therein, respectively. Cleaning tip 20 is dimensioned to pass through and effectively clean (when combined with a cleaning patch) a rifle barrel and cleaning tip 22 is dimensioned to pass through and effectively clean a shotgun barrel. A threaded stem 36 capable of threadably and detachably engaging either coupling 14*a* or 14*b* is provided at one end of cleaning tip 20. Because it is dimensioned for cleaning a shotgun barrel, cleaning tip 22 has a larger threaded stem 38 at one end. An adaptor coupling 24 having a threaded stem 40 at one end capable of threadably and detachably engaging either universal coupling 14*a* or 14*b*, and a threaded internal bore 42 at the other end, is provided. Stem 38 is dimensioned to threadably engage internal bore 42 in adaptor coupling 24, the combination of cleaning tip 22 and coupling 24 being securable to either universal coupling 14*a* or 14*b* by stem 40.

Cleaning tip 26 comprises a T-shaped handle including an elongated portion 44 having a smooth transverse bore 46 therethrough. Located within bore 46 is a cylindrical bar 48. One end of cleaning tip 26 has a threaded stem 50 for threadable and detachable engagement with either universal coupling 14*a* or 14*b*. As discussed below, gun barrel cleaner 10 is capable of withstanding significant pulling force or pressure without breaking. Cleaning tip 26 facilitates the application during gun barrel cleaning of moderate to high pulling pressure by providing structure by which an individual can securely grip the gun barrel cleaner.

Cleaning tips 28 and 30 comprise gun barrel bore obstruction removers. Cleaning tip 28 has a cylindrical body portion 52 dimensioned for cleaning a rifle barrel and cleaning tip 30 has a cylindrical body portion 54 dimensioned for cleaning a shotgun barrel. Cleaning tips 28 and 30 each have a concave face 56 and 58, respectively, at one end and a threaded stem 60 and 62 (see FIG. 4), respectively, at the other end. As discussed below, concave end faces 56 and 58 are particularly designed to assist in the safe removal of bullet obstructions. Threaded stems 60 and 62 are dimensioned to threadably and detachably engage either universal coupling 14*a* or 14*b*. When attached to shaft 12, either cleaning tip 28 or 30 operates to dislodge a gun barrel bore obstruction by impacting the obstruction. Because of this, they are preferably solid and manufactured from a fairly heavy material so as to provide sufficient impacting weight. As hereinafter discussed in connection with FIG. 4, a unique means of attaching cleaning tip 30 to couplings 14*a* is provided due to the weight of shotgun cleaning tip 30.

Figure 2:
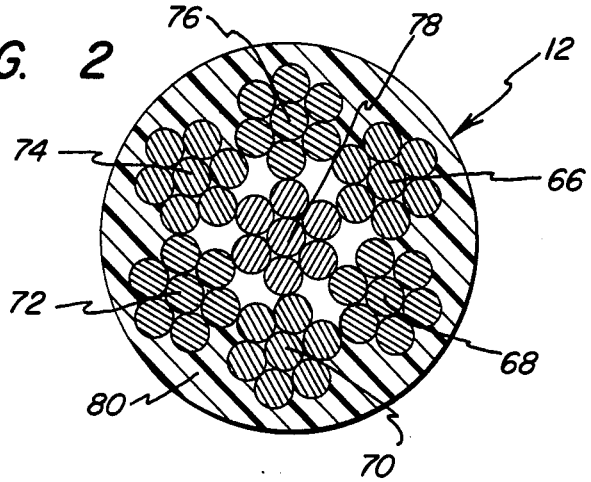
FIG. 2 is a cross-sectional view of the flexible shaft shown in FIG. 1 taken along lines 2—2.

A cross-section of flexible shaft 12 is shown in FIG. 2. Shaft 12 comprises galvanized steel wire bundles 66, 68, 70, 72, 74 and 76 spirally wound about a core, galvanized steel wire bundle 78. Each wire bundle consists of a plurality of wires, seven wires having been found to work particularly well. Although this 49-wire arrangement is preferred, it should be understood that the present invention is not limited to just such an arrangement.

For example, the number of wires in the bundles, the number of wire bundles or both may vary. Surrounding wire bundles 66, 68, 70, 72, 74, 76 and 78 is a protective nylon coating 80 capable of shedding solvents, dirt and other abrasive materials which could scratch or otherwise damage a gun barrel. Coating 80 is applied to the wrapped wire bundles by drawing the bundles through a bath of extrudable nylon and then a forming die. Other materials could be used for coating 80, e.g. vinyl, polyethylene or polypropylene. The 49-wire arrangement coated with nylon however, is preferred since such a construction results in a very flexible shaft which can be easily stored in a very compact container. Lastly with respect to shaft 12, it is desirable to minimize for compact storage the length of shaft 12 to the extent possible without sacrificing function. Thirty inches is believed the minimum length needed to clean any rifle or shotgun barrel after cleaning tips have been attached to couplings **14*a* and 14*b***.

Figure 3:
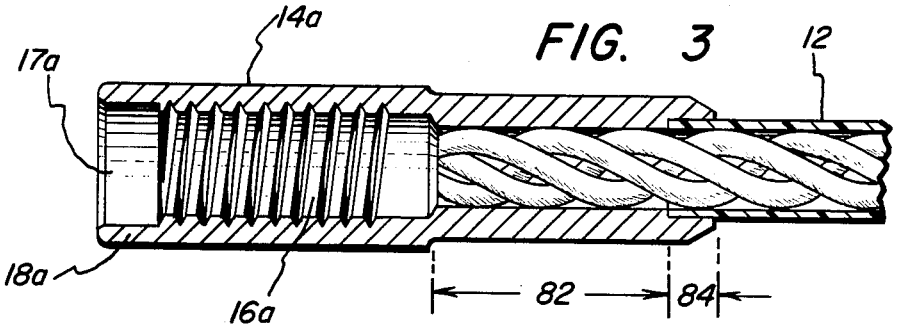
FIG. 3 is a side cross-sectional view of one end of the flexible shaft shown in FIG. 1 taken along lines 3—3.

As already noted, attached to opposite ends of shaft 12 are couplings **14*a* and 14*b*. Preferably, couplings 14*a* and 14*b* are manufactured of brass and crimped or cold welded onto the ends of shaft 12. Referring to FIG. 3, coupling 14*a* is cold welded onto the end of shaft 12 (as is coupling 14*b*) primarily over a bare wire interior section 82, comprising the combination of wire bundles 66, 68, 70, 72, 74, 76 and 78, and partially over a wire interior coated with nylon section 84. The end of coupling 14*a* to be cold welded onto shaft 12 is preferably closely toleranced to sections 82 and 84**.

Cold welding of couplings **14*a* and 14*b* to shaft 12 is accomplished in a standard manner, for example a hydraulic or mechanical press and a hexagonal shaped die may be used. Cold welding each coupling 14*a* and 14*b* three times on different sides using a 15-ton hydraulic press is believed preferable to accomplish the objectives of the present invention. When cold welded, brass from couplings 14*a* and 14*b* flows within and meshes with the numerous surfaces formed by the combination of wire bundles 66, 68, 70, 72, 74, 76 and 78. This action produces the unexpectedly strong securement of couplings 14*a* and 14*b* to shaft 12. Most, if not all, previous gun barrel devices having flexible shafts can only withstand pulling pressures in the 50–150 pound range (150 pounds being the minimum acceptable breaking point dictated by military specifications). Gun barrel cleaner 10** however, can consistently withstand pulling pressures in the 150–400 pound range without breaking, which provides a significant advantage over prior compactable cleaning devices having flexible shafts.

As noted, couplings **14*a* and 14*b* are preferably cold welded partially over a wire interior coated with nylon section 84. This ensures wire interior 82 will not be exposed should coupling 14*a* or 14*b* become bent, thus preventing either the possibility of corrosive materials reaching wire interior 82 where they could be retained or the possibility of having an exposed end of nylon coating 80 which could be damaged, or both. Lastly with respect to FIG. 3, threaded bore 16*a* is preferably undercut at free end 18*a* to provide a relief area 17*a*. This ensures that cleaning tips 20, 26, 28 and 30 and adaptor 24 will be fully threadably securable therein. Universal coupling 14*b* and adaptor coupling 24** are also provided with similar areas of relief. An important benefit of providing relief areas within the couplings' threaded bores instead of on the cleaning tips' threaded stems is the increased force needed to break a cleaning tip from a coupling, thus providing a more durable gun cleaning device.

Cleaning tip 30, designed to remove bore obstructions from shotgun barrels, will now be described in greater detail with reference to FIG. 4 where cleaning tip 30, universal coupling **14*a* and a bullet obstruction 86 are shown in cross-sectional view within a shotgun barrel 88. As described briefly above, cleaning tip 30 has a cylindrical body portion 54, a concave face 58 at one end and a threaded stem 62 at the other. Threaded stem 62 is located within a smooth internal bore 90 in the end of body portion 54 opposite that end having concave face 58. Threaded stem 62 is threadably secured at one end 92 within a threaded bore 94 in cylindrical body portion 54. An allen head 96, adapted to receive an appropriate hexagonal wrench tool, is provided in the free end 98 of threaded stem 62 to facilitate securement of stem 62 within bore 94. Internal bore 90 is dimensioned such that couplings 14*a* and 14*b* may be selectively positioned therein to threadably and detachably engage threaded stem 62. By recessing threaded stem 62 within smooth internal bore 90, strong securement of coupling 14*a* against lateral side pressure $P_s$ is obtained. This is because coupling 14*a* partially resides within internal bore 90, thus side pressures $P_s$ are partially absorbed by the external surface of coupling 14*a* contacting the internal surface of bore 90**. Obviously, for the contacting of these surfaces to absorb significant side pressure they must be fairly closely toleranced when constructed.

Figure 4:
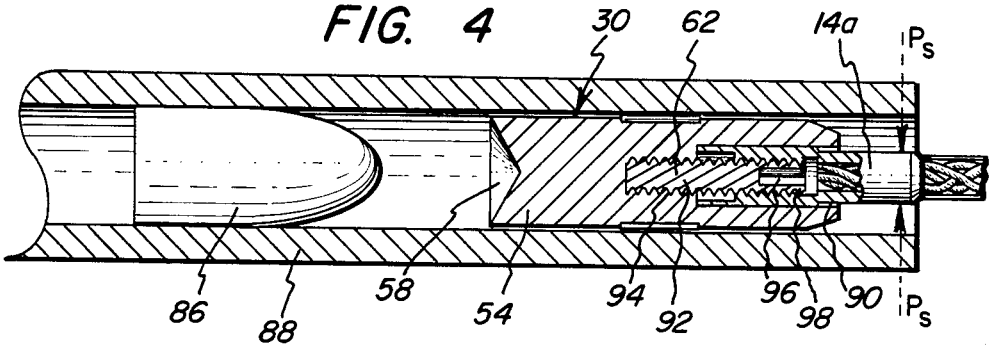
FIG. 4 is a cross-sectional view of a gun barrel, a bullet obstruction and an obstruction remover cleaning tip secured to the flexible shaft in position to dislodge the obstruction.

As shown in FIG. 4, concave end face 58 assists in centering cleaning tip 30 about bullet obstruction 86. This reduces the chance of lodged bullet 86 accidentally exploding within gun barrel 88 when being removed since there is less chance of cleaning tip 30 being trapped between the inner surface of gun barrel 88 and bullet 86. The particular dimensions of concave end face 58 can vary, but should be sufficient to accomplish the objective of centering cleaning tip 30 about bullet 86.

In addition to couplings **14*a* and 14*b*, cleaning tips 20, 22, 26, 28 and 30 along with adaptor coupling 24, are preferably manufactured of brass. Brass is preferable since it is a "soft" metal which is less likely to scratch or otherwise damage a gun barrel. Further, each brass coupling and cleaning tip is chromic bright dipped to remove hardened surface impurities, and then lightly sealed to prevent surface corrosion, which makes these components even less likely to damage a gun barrel. Adaptor coupling 24 and cleaning tips 28 and 30 each have knurled sections 104, 106 and 108 respectively, which facilitate an individual's ability to attach and detach these components to and from couplings 14*a* and 14*b***.

An alternate embodiment 10' of the gun barrel cleaner invention is shown perspectively in FIG. 5. Gun barrel cleaner 10' includes a flexible shaft 12' substantially identical to shaft 12 of gun barrel cleaner 10, and a universal coupling 14', substantially identical to universal couplings **14*a* and 14*b*, secured to one of shaft 12'. Coupling 14' includes a threaded internal bore 16' to which different cleaning tips may be threadably attached. Secured to the other end of shaft 12' is a combination cleaning tip 112. Cleaning tip 112 and coupling 14' are preferably manufactured of brass and similarly secured to shaft 12' as explained above in connection with securement of couplings 14*a* and 14*b* to shaft 12**.

Cleaning tip 112 comprises in part an obstruction remover similar in operation to cleaning tips 28 and 30. Cleaning tip 112 has a cylindrical body portion 114 and a concave face 116 at its free end 118. Additionally, cleaning tip 112 has a smooth bore 120 transverse through cylindrical body portion 114. A smooth cylindrical bar 122 is also provided and dimensioned for insertion into bore 120. When cylindrical bar 122 is located within bore 120 a T-shaped handle is formed by cleaning tip 112. This T-shaped handle may be used to facilitate the application during gun barrel cleaning of increased pulling pressure to gun barrel cleaner 10'.

Another embodiment 124, specifically designed for cleaning pistols, of the gun barrel cleaner of the present invention is illustrated in FIG. 6. Gun barrel cleaner 124 comprises several cleaning tips and cylindrical cleaning tubes which can be selectively attached to and detached from each other. A first cylindrical cleaning tube or rod 126 has substantially identical threaded internal bores **128*a* and 128*b* at opposite ends. A plurality of second cylindrical cleaning tubes or rods 130, 132 and 134, have threaded internal bores 136*a*, 136*b* and 136*c*, respectively, at one end and threaded stems 138*a*, 138*b* and 138*c*, respectively, at their other ends. Threaded internal bores 136*a*, 136*b* and 138*c* are substantially identical to bores 128*a*, and 128*b* in a rod 126. Threaded stems 138*a*, 138*b* and 138*c* are capable of selective threadable and detachable engagement with either threaded bores 128*a*, 128*b*, 136*a*, 136*b* or 136*c***.

Cleaning tips included within gun barrel cleaner 124 comprise: an obstruction remover cleaning tip 140, a T-shaped handle cleaning tip 142 and a slotted, patch receiving cleaning tip 144. Each cleaning tip 140, 142 and 144 has a threaded stem 146, 148 and 150, respectively, at one end capable of selective threadable and detachable engagement with threaded bores **128*a*, 128*b*, 136*a*, 136*b* and 136*c*. Cleaning tips 140 and 144 are dimensioned to pass through and clean pistol barrels and chambers, but otherwise are identical to cleaning tips 28 and 20, respectively, of gun barrel cleaner 10 discussed above. Obstruction remover tip 140 has a cylindrical body portion 152 and a concave face 154 at one end 156, and cleaning tip 144 has a patch receiving slot 166 therein. Cleaning tip 142 has an elongated body 158 with a smooth transverse bore 160 therethrough. Slidably entrained, by partially flattened or staked ends 164*a* and 164*b*, within transverse bore 160 is a cylindrical bar 162**.

As described in connection with gun barrel cleaner 10, first cylindrical rod 126, second cylindrical rods 130, 132 and 134, and cleaning tips 140, 142 and 144 are preferably manufactured of brass, and chemically treated in a chromic acid bath to remove surface impurities and then sealed to prevent corrosion. Individual lengths of three inches for first cylindrical rod 126 and second cylindrical rods 130, 132 and 134 are preferable for storage, and cleaning of most pistol barrels and chambers.

In operation, gun barrel cleaner 124 only requires assemblage of those components necessary to accomplish the particular cleaning task desired. For example, if a short barrel, chamber, or revolver cylinder is to be cleaned, first cylindrical rod 126 and the appropriate cleaning tips may be sufficient. By being able to appropriately size the gun barrel cleaner needed, increased leverage is available for cleaning as compared with typically oversized gun barrel cleaners. Flexibility is an important feature of gun barrel cleaner 124. Cleaning tip 142 further enhances the versatility of gun barrel cleaner 124. Since cylindrical bar 162 is slidable relative to elongated portion 158, cleaning tip 142 can be used in close proximity to a pistol being cleaned without hampering the cleaning operation.

Figure 7:
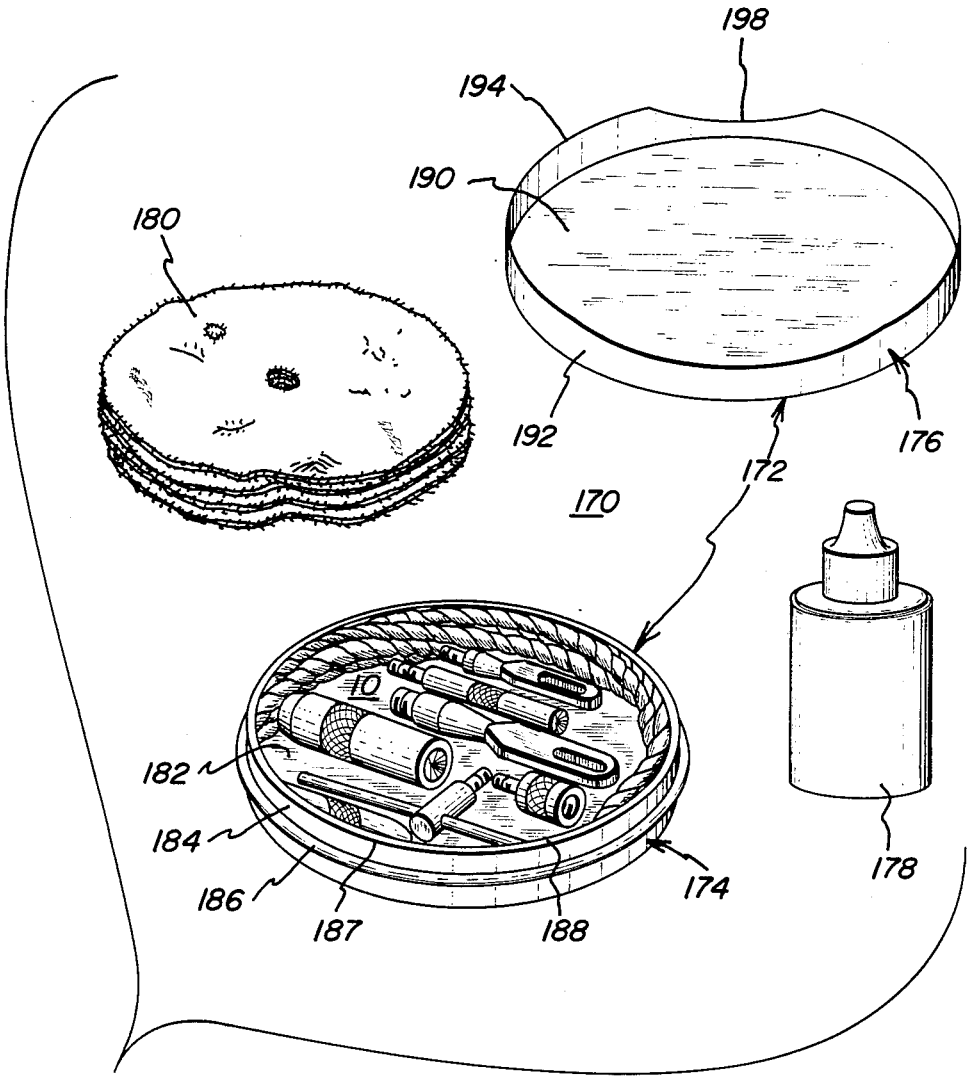
FIG. 7 is a perspective view of a gun barrel cleaning kit of the present invention consisting of a gun barrel cleaner and a compact cylindrical container for storing and transporting the gun barrel cleaner.

A gun barrel cleaning kit 170 of the present invention is shown perspectively in FIG. 7. Cleaning kit 170 comprises gun barrel cleaner 10, a compact container 172, a refillable vial 178 of barrel cleaning solution and several gun barrel cleaning patches 180. Alternatively, gun barrel cleaner 10' or gun barrel cleaner 124 could be included individually or in combination within gun barrel cleaning kit 170.

When closed, compact container 172 has a short cylindrical shape with preferable dimensions of approximately 3 and 178 inches in diameter and 1 inch in height. Such dimensions are important in that they allow container 172 to be conveniently inserted within a typical shirt, pants or coat pocket for carrying. Container 172 includes a bottom portion 174 and a removable top portion 176. Bottom portion 174 has a substantially flat bottom surface 182 and a continuous cylindrical side wall 184 extending therefrom. Integrally formed with cylindrical side wall 184 is an outwardly protruding ledge 186 and an internally protruding lip 188. Internally protruding lip 188, preferably located near the top edge 187 of cylindrical side wall 184, operates to retain shaft 12 with couplings **14*a* and 14*b* secured thereto in a coiled position within bottom portion 184. This lip therefore enhances safety by requiring an individual to manually remove shaft 12 rather than allowing shaft 12 to "spring out" from container 172 whenever top portion 176 is removed from bottom portion 174**.

Top portion 176 includes a substantially flat top surface 190 with a continuous cylindrical side wall 192 projecting therefrom. The diameter of cylindrical side wall 192 of top portion 176 is slightly greater than that of cylindrical side wall 184 of bottom portion 174 so that top portion 176 will fit over bottom portion 174. When closed, free edge 194 of cylindrical side wall 192 engages protruding ledge 186 in bottom portion 174 to form a watertight seal. Valleys 196 and 198 in free edge 194 of top portion 176 provide a convenient method to open container 172 in a well known manner (i.e., by the application of downward pressure to top surface 190 near either valley 196 or 198). Container 172 may have camouflage coloring on its exterior surfaces if desired. Gun cleaner 10, vial 178 and cleaning patches 180 are all designed to fit within container 172.

Lastly, an improved method of attaching a gun barrel cleaning patch 200 to a cleaning tip 206 having a patch receiving slot 208 therein will be described with reference to the illustrations of FIGS. **8*a*–*e*. Cleaning patch 200 comprises a circular body member having a first hole 202 near its center and a second hole 204 close to an edge. The improved patch attachment method includes the steps of placing cleaning patch 200 over an end 210 of cleaning tip 206 (see FIG. 8*a*), folding an edge portion 212 of cleaning patch 200 together on either side of cleaning tip 206 (see FIG. 8*b*), feeding folded portion 212 of cleaning patch 200 through patch receiving slot 205 (see FIG. 8*c*) and pulling taut folded portion 212 through patch receiving slot 208 (see FIG. 8*d*). When cleaning tip 206 having cleaning patch 200 secured thereto in such a manner is pulled through a gun barrel bore, cleaning patch 200 surrounds cleaning tip 206 in a substantially uniform manner and thus provides enhanced gun barrel cleaning (see FIG. 8*e*). For large diameter gun barrels, end 210 of cleaning tip 206 is placed through first hole 202 and for small diameter gun barrels, it is placed through second hole 204. By attaching cleaning tip 206 to patch 200 through hole 204, a greater portion of patch 200 can trail cleaning tip 206 when in a gun barrel, thereby reducing the effective diameter of the cleaning tip 216 and patch 200** combination.

It will be noted that this invention fully meets the objectives set forth. A gun barrel cleaner capable of withstanding high pulling stresses yet versatile enough to clean a wide range of gun barrels quickly and efficiently is provided. Further, a compact container is provided for convenient storing and transporting of such a gun barrel cleaner. Lastly, it will be observed that the improved method of attaching a gun cleaning patch to a gun cleaning tip having a patch receiving slot therein allows for a more efficient cleaning of a gun barrel.

Although several embodiments have been illustrated in the accompanying drawings and described in the foregoing detailed description, it will be understood that the invention is not limited to the embodiments discussed but is capable of numerous rearrangements, modifications, and substitutions without departing from the scope of the invention. For example, various cleaning tips, such as brushes, swabs, etc., may be used in combination with the gun barrel cleaner. Other changes, within the scope of the invention as defined by the appended claims, will suggest themselves to those skilled in this art.

What is claimed is:

1. A gun barrel cleaner comprising:

a shaft substantially unyielding in an axial direction or barrel cleaning and laterally bendable for compact coiling, said shaft having a wire interior comprising a plurality of wire bundles coiled about a single wire bundle such that a multitude of interstices exist within said wire interior, said shaft also having a flexible exterior coating surrounding said wire interior, a portion of said flexible exterior coating at each end of said shaft being removed to expose said wire interior;

two universal brass couplings, each coupling having a substantially identical threaded internal bore, said universal couplings being cold welded onto said exposed portions of wire interior at opposite ends of said shaft such that brass from said couplings resides within the interstices of said exposed wire interior at said shaft ends, said universal couplings and said exposed portions of wire interior being dimensioned such that said exposed portions of wire interior and sections of said shaft adjacent thereto are covered by said couplings when said couplings are cold welded onto said shaft; and at least two different cleaning tips, each of said tips having a threaded stem at one end for threadable and detachable engagement with said threaded internal bore within either of said universal couplings, one of said at least two different tips comprising a first cleaning tip having an obstruction remover at one end and said threaded stem at its other end, said obstruction remover including a cylindrical body portion having a concave end face so that when dislodging a bullet obstruction from a gun barrel bore said concave end face will center said obstruction remover about said bullet to facilitate the safe removal of said obstruction, whereby said shaft with said couplings secured thereto is capable of consistently withstanding high pulling pressure without said couplings breaking away from said shaft and said cleaning tips are selectively attachable to and detachable from said universal couplings at either end of said shaft thereby facilitating cleaning of a gun barrel.

2. The gun barrel cleaner of claim 1 wherein another of said at least two different cleaning tips comprises a second cleaning tip having a slot for receiving a cleaning patch at one end and said threaded stem at its other end.

3. The gun barrel cleaner of claim 2, further comprising a third tip having a T-shaped handle at one end and a threaded stem at the other end, said third tip's threaded stem being threadably and detachably engageable with said threaded internal bore within either of said universal couplings.

4. The gun barrel cleaner of claim 3, wherein said first and second tips are appropriately dimensioned for use in cleaning a rifle barrel.

5. The gun barrel cleaner of claim 12, further comprising:

an adaptor coupling having a threaded internal bore at one end and a threaded stem at the other end, said adaptor coupling's threaded internal bore being larger than the threaded internal bore within either of said universal couplings, and said adaptor coupling's threaded stem being threadably and detachably engageable with said threaded internal bore within either of said universal couplings; and a fourth tip appropriately dimensioned for use in cleaning a shotgun barrel, said fourth tip having a slot for receiving a cleaning patch at one end and a threaded stem at the other end, said fourth tip's threaded stem being threadably and detachably engageable with said adaptor coupling's threaded internal bore, whereby said fourth tip may be used in combination with said adaptor coupling and said shaft to clean a shotgun barrel.

6. The gun barrel cleaner of claim 5, further comprising a fifth tip appropriately dimensioned for use in cleaning a shotgun barrel, said fifth tip having an obstruction remover at one end and a threaded stem at the other end, said fifth tip's threaded stem being threadably and detachably engageable with said threaded internal bore within either of said universal couplings.

7. The gun barrel cleaner of claim 6, wherein said fifth tip's obstruction remover comprises a cylindrical body portion having a concave face at one end and wherein said fifth tip's threaded stem is recessed within an internal bore in the end of said cylindrical body portion opposite that end having said concave face.

8. The gun barrel cleaner of claim 7, wherein said first tip, second tip, third tip, fourth tip, fifth tip and adaptor coupling are manufactured of brass.

9. The gun barrel cleaner of claim 8, wherein said universal adaptors, first tip, second tip, third tip, fourth tip, fifth tip and adaptor coupling are chemically treated with chromic acid to remove surface impurities and then chemically sealed to prevent corrosion.

10. The gun barrel cleaner of claim 9, further comprising a compact cylindrical container having a bottom portion and a removable top portion, said bottom portion having lip means protruding inwardly for retaining said shaft with universal couplings secured thereto in a coiled position therein such that when said top portion is removed from said bottom portion said shaft with universal couplings secured thereto will remain within said container in said coiled position until manually removed.

11. A gun barrel cleaner, comprising:

a shaft substantially unyielding in an axial direction for barrel cleaning and laterally bendable for compact coiling;

a universal coupling secured to one end of said shaft, said universal coupling having a threaded internal bore for threadable attachment of various cleaning tips to said shaft;

an obstruction remover tip secured to the other end of said shaft, said obstruction remover tip having a cylindrical body portion and a concave end face, said cylindrical body portion having a transverse bore therethrough; and a cylindrical bar removably insertable within said transverse bore to form a T-shaped handle, whereby said obstruction remover tip may be used to dislodge a gun barrel bore obstruction and said T-shaped handle formed by inserting said cylindrical bar within said transverse bore may be used to pull a cleaning tip attached to said universal coupling through a gun barrel.

12. The gun barrel cleaner of claim 11, wherein said shaft has a wire interior surrounded by a flexible nylon exterior.

13. The gun barrel cleaner of claim 12, wherein said wire interior comprises a plurality of wire bundles coiled about a single wire bundle.

14. The gun barrel cleaner of claim 13, wherein said universal coupling and said obstruction remover tip are manufactured of brass.

15. The gun barrel cleaner of claim 14, wherein said universal coupling and said obstruction remover tip are cold welded onto the ends of said shaft.

16. The gun barrel cleaner of claim 15, wherein said universal coupling and said obstruction remover tip are cold welded onto the ends of said shaft over part wire interior and part wire interior surrounded by nylon exterior.

17. The gun barrel cleaner of claim 16, in combination with a short cylindrical can having a bottom portion with a lip protruding inwardly and a removable top portion, such that said shaft with universal coupling at one end and obstruction remover at the other end may be stored in a coiled position within said bottom portion and retained therein by said inwardly lip.

18. A pistol barrel cleaner comprising:

a first cylindrical cleaning rod having substantially identical threaded internal bores at each end and a length slightly larger than the length of a pistol chamber to be cleaned;

at least one second cylindrical cleaning rod having a threaded stem at one end and a threaded internal bore at the other end, said second cylindrical cleaning rod's threaded internal bore being substantially identical to said first cylindrical cleaning rod's threaded internal bores, and said second cylindrical cleaning rod's threaded stem being threadably and detachably engageable with either of said threaded internal bores within said first cylindrical cleaning rod;

at least two different cleaning tips, each of said tips having a threaded stem at one end for threadable and detachable engagement with any of said threaded internal bores in said first and second cylindrical cleaning rods, one of said at least two different cleaning tips comprising an obstruction remover including a cylindrical body portion having a concave end face such that when dislodging a bullet obstruction from a gun barrel bore said concave end face will center said obstruction remover about said bullet and thereby facilitate safe removal of said obstruction, whereby said cleaning tips may be selectively attached to and detached from said first cylindrical cleaning rod at either end or selectively attached to and detached from either end of the combination formed by attaching said first and second cylindrical cleaning rods together.

19. The pistol barrel cleaner of claim 18, wherein said first cylindrical cleaning rod, second cylindrical cleaning rod and cleaning tips are manufactured of brass and chemically treated with chromic acid to remove surface impurities and then chemically sealed to prevent corrosion.

20. A gun barrel obstruction remover tip comprising:

a cylindrical body portion having a concave face at one end and means for securing said body portion to a gun barrel cleaning shaft at the other end such that when secured to a cleaning shaft said obstruction remover tip may be used to dislodge an obstruction within a gun barrel bore by impacting said obstruction, whereby if the obstruction is a bullet said concave face will maintain said obstruction remover in a centered position about the bullet thereby facilitating the bullet's safe removal.

21. The obstruction remover tip of claim 20, wherein said cylindrical body portion is solid and manufactured of a material non-abrasive to a gun barrel.

22. The obstruction remover tip of claim 21, wherein said non-abrasive material is brass.

23. The obstruction remover tip of claim 22, wherein the tip is chemically treated with chromic acid to remove surface impurities and then chemically sealed to prevent corrosion.

24. The obstruction remover tip of claim 21, wherein said means for securing said body portion to a gun barrel cleaning shaft comprises a threaded stem threadably and detachably engageable with one end of the gun barrel cleaning shaft.

25. The obstruction remover tip of claim 24, wherein said threaded stem is recessed within an internal bore at the end of said cylindrical body portion opposite that end having said concave face such that when threadedly secured to one end of a gun barrel cleaning shaft, said shaft will partially be located within said internal bore thereby increasing the magnitude of lateral force absorbable before said obstruction remover tip will break from said shaft.

26. An improved gun barrel cleaning patch in combination with a gun barrel cleaning tip having a patch receiving slot therein, said cleaning patch comprising a body member manufactured of a textile fabric, said body member having a hole approximately at its center through which an end of said gun barrel cleaning tip having the receiving slot therein is inserted, whereby a portion of said cleaning patch on one side of said cleaning tip may be fed through said receiving slot and the resulting combination use to more effectively clean a gun barrel.

27. The combination of claim 26, wherein said body member has at least two holes therein, one hole being approximately at the body member's center and the other hole being near an edge of the body member, whereby an end of said gun barrel cleaning tip having the receiving slot therein may be selectively inserted through either hole.

28. The combination of claim 26, wherein said body member is circular and said textile fabric is woven cotton.

29. A method of affixing a gun barrel cleaning patch having at least one hole therein to a gun barrel cleaning tip having a slot for receiving said patch therein, comprising the steps of:

placing an end of said gun barrel cleaning tip through a hole in said cleaning patch and holding said patch near said tip's patch receiving slot;

folding an edge portion of said cleaning patch together on one side of said tip;

feeding said folded portion through said patch receiving slot in said tip; and pulling said folded portion fed through said patch receiving slot taut, whereby when pulled through a gun barrel said patch will completely surround said tip, thereby providing improved gun barrel cleaning.

* * * * *

UNITED STATES PATENT AND TRADEMARK OFFICE

CERTIFICATE OF CORRECTION

PATENT NO. : 4,716,673

DATED : January 5, 1988

INVENTOR(S) : Gerald & Doreen Williams

It is certified that error appears in the above-identified patent and that said Letters Patent is hereby corrected as shown below:

Claim 1, line 34; "or" should read "for"

Claim 5, line 22; "12" should read "4"

Claim 17, line 44; between "inwardly" and "lip" insert --protruding--

Claim 26, line 62; "use" should read "used".

Signed and Sealed this

Fourteenth Day of June, 1988

*Attest:*

*Attesting Officer*

DONALD J. QUIGG

*Commissioner of Patents and Trademarks*